US008449068B2

(12) United States Patent
Govyadinov

(10) Patent No.: US 8,449,068 B2
(45) Date of Patent: May 28, 2013

(54) LIGHT-SCATTERING DROP DETECTOR

(75) Inventor: Alexander Govyadinov, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 569 days.

(21) Appl. No.: 12/388,805

(22) Filed: Feb. 19, 2009

(65) Prior Publication Data

US 2010/0207989 A1 Aug. 19, 2010

(51) Int. Cl.
*B41J 29/393* (2006.01)
*B41J 29/38* (2006.01)

(52) U.S. Cl.
USPC ..... 347/19; 347/9; 347/14

(58) Field of Classification Search
USPC ..... 347/9, 19, 14, 23
See application file for complete search history.

(56) References Cited

U.S. PATENT DOCUMENTS

| | | | | |
|---|---|---|---|---|
| 4,422,719 | A | | 12/1983 | Orcutt |
| 5,304,814 | A | | 4/1994 | Markham |
| 5,428,218 | A | | 6/1995 | Toughlian et al. |
| 5,589,858 | A | | 12/1996 | Kadowaki et al. |
| 5,621,524 | A | * | 4/1997 | Mitani ..... 356/338 |
| 5,742,303 | A | | 4/1998 | Taylor et al. |
| 5,774,141 | A | | 6/1998 | Cooper et al. |
| 5,856,833 | A | * | 1/1999 | Elgee et al. ..... 347/19 |
| 5,896,145 | A | | 4/1999 | Osborne et al. |
| 6,088,134 | A | | 7/2000 | Schmidt |
| 6,168,258 | B1 | | 1/2001 | Lou et al. |
| 6,299,275 | B1 | | 10/2001 | Elgee |
| 6,513,900 | B2 | | 2/2003 | Endo et al. |
| 6,517,184 | B1 | | 2/2003 | Bruch et al. |
| 6,525,863 | B1 | | 2/2003 | Riza |
| 6,565,179 | B1 | | 5/2003 | Bruch et al. |
| 6,585,349 | B1 | | 7/2003 | Lou et al. |
| 6,648,444 | B2 | | 11/2003 | Valero et al. |
| 6,747,684 | B2 | | 6/2004 | Ornellas et al. |
| 6,767,122 | B2 | | 7/2004 | Honguh et al. |
| 6,769,756 | B2 | | 8/2004 | Su et al. |
| 6,786,626 | B2 | | 9/2004 | Wu et al. |
| 6,802,580 | B2 | | 10/2004 | Valero |
| 6,814,422 | B2 | | 11/2004 | Bruch et al. |
| 6,851,816 | B2 | | 2/2005 | Wu et al. |
| 6,877,838 | B2 | | 4/2005 | Elgee |
| 6,935,717 | B2 | | 8/2005 | Su et al. |

(Continued)

FOREIGN PATENT DOCUMENTS

| | | |
|---|---|---|
| JP | 2001113725 | 4/2001 |
| JP | 2005083769 | 3/2005 |

(Continued)

OTHER PUBLICATIONS

Svanholm, Erik, "Printability and Ink-Coating Interactions in Inkjet Printing," Dissertation, Karlstad University Studies 2007:2, pp. 58 (Feb. 2007).

(Continued)

*Primary Examiner* — Jason Uhlenhake

(57) ABSTRACT

A drop detector has a light-source and a light detector. The light-source is configured to scatter light off two or more substantially currently ejected drops. The light detector is configured to substantially concurrently sense, respectively at two or more different spatial locations, the light scattered off the two or more substantially currently ejected drops.

11 Claims, 8 Drawing Sheets

U.S. PATENT DOCUMENTS

| | | | |
|---|---|---|---|
| 6,966,664 | B2 | 11/2005 | Wu |
| 6,969,159 | B2 | 11/2005 | Su et al. |
| 6,984,013 | B2 | 1/2006 | Arqullevich et al. |
| 7,055,925 | B2 | 6/2006 | Subirada et al. |
| 7,125,151 | B2 | 10/2006 | Uemura et al. |
| 7,140,762 | B2 | 11/2006 | Wu et al. |
| 7,249,830 | B2 | 7/2007 | Hawkins et al. |
| 7,267,467 | B2 | 9/2007 | Wu et al. |
| 7,287,824 | B2 | 10/2007 | Subirada et al. |
| 7,287,833 | B2 | 10/2007 | Howard |
| 7,364,276 | B2 | 4/2008 | Piatt et al. |
| 7,434,919 | B2 | 10/2008 | Hawkins et al. |
| 7,442,180 | B2 | 10/2008 | Vitello et al. |
| 7,452,053 | B2 | 11/2008 | Valles et al. |
| 7,490,918 | B2 | 2/2009 | Nagashima |
| 7,513,616 | B2 | 4/2009 | Lin |
| 7,832,822 | B2 | 11/2010 | Kiyama et al. |
| 2001/0019480 | A1 | 9/2001 | Fujino et al. |
| 2003/0193608 | A1 | 10/2003 | Yen |
| 2003/0218648 | A1 | 11/2003 | Barnes et al. |
| 2004/0254527 | A1 | 12/2004 | Vitello et al. |
| 2005/0021244 | A1 | 1/2005 | Nicoli et al. |
| 2005/0024410 | A1 | 2/2005 | Subirada et al. |
| 2005/0253890 | A1 | 11/2005 | Nagashima |
| 2006/0103691 | A1 | 5/2006 | Dietl et al. |
| 2006/0120098 | A1 | 6/2006 | Ikeda et al. |
| 2006/0139392 | A1 | 6/2006 | Fernandez et al. |
| 2006/0187651 | A1 | 8/2006 | Kim et al. |
| 2006/0279601 | A1 | 12/2006 | Unosawa et al. |
| 2007/0024658 | A1 | 2/2007 | Diol et al. |
| 2007/0030300 | A1 | 2/2007 | Jeong |
| 2007/0064068 | A1 | 3/2007 | Piatt et al. |
| 2008/0180470 | A1 | 7/2008 | Oku |
| 2008/0246803 | A1 | 10/2008 | Barger et al. |
| 2009/0027459 | A1 | 1/2009 | Hawkins et al. |
| 2009/0091595 | A1 | 4/2009 | Hayashi et al. |
| 2009/0141057 | A1 | 6/2009 | Hayashi et al. |
| 2009/0179934 | A1 | 7/2009 | Takagi et al. |
| 2009/0244141 | A1 | 10/2009 | Govyadinov et al. |
| 2009/0244163 | A1 | 10/2009 | Govyadinov |
| 2009/0273620 | A1 | 11/2009 | Govyadinov et al. |
| 2009/0310206 | A1 | 12/2009 | Gluckstad |
| 2011/0090275 | A1 | 4/2011 | Govyadinov et al. |
| 2012/0013906 | A1 | 1/2012 | Govyadinov et al. |

FOREIGN PATENT DOCUMENTS

| | | |
|---|---|---|
| JP | 2006047235 | 2/2006 |
| JP | 2006346906 | 12/2006 |
| JP | 2007111971 | 5/2007 |
| WO | 2007015808 | 2/2007 |
| WO | 2009120436 | 10/2009 |

OTHER PUBLICATIONS

The Written Opinion of the International Searching Authority for International Application No. PCT/US2009/034892 mailed Jul. 28, 2009 (5 pages).

The International Search Report for International Application No. PCT/US2009/034892 mailed Jul. 28, 2009 (3 pages).

The Restriction Requirement for U.S. Appl. No. 12/381,873 mailed on Sep. 29, 2010 (6 pages).

The Restriction Requirement for U.S. Appl. No. 12/079,338 mailed on Mar. 17, 2011 (7 pages).

The Office Action for U.S. Appl. No. 12/254,864 mailed on Jun. 11, 2010 (23 pages).

The Office Action for U.S. Appl. No. 12/381,873 mailed on Feb. 4, 2011 (12 pages).

The Office Action for U.S. Appl. No. 12/079,338 mailed on Jul. 25, 2011 (15 pages).

The Office Action for U.S. Appl. No. 12/381,873 mailed on Sep. 1, 2011 (11 pages).

The Notice of Allowance for U.S. Appl. No. 12/254,864 mailed on Dec. 1, 2010 (12 pages).

McLeod, Euan et al., "Complex Beam Sculpting with Tunable Acoustic Gradient Index Lenses," SPIE, Complex Light and Optical Forces, vol. 6483, pp. 1-9, (2007).

The Office Action for U.S. Appl. No. 12/079,338 mailed May 25, 2012 (6 pages).

The Office Action for U.S. Appl. No. 12/079,338 mailed Dec. 12, 2012 (7 pages).

The Final Office Action for U.S. Appl. No. 12/079,338 mailed Feb. 8, 2012 (7 pages).

The Advisory Action for U.S. Appl. No. 12/079,338 mailed Apr. 18, 2012 (3 pages).

The Notice of Allowance for U.S. Appl. No. 12/381,873 mailed Feb. 8, 2012 (15 pages).

The Notice of Allowance for U.S. Appl. No. 12/837,098 mailed Sep. 10, 2012 (8 pages).

The Office Action for U.S. Appl. No. 12/837,098 mailed Apr. 26, 2012 (20 pages).

The Office Action for U.S. Appl. No. 12/581,712 mailed Oct. 15, 2012 (25 pages).

* cited by examiner

LIGHT-SCATTERING DROP DETECTOR

BACKGROUND

During inkjet printing ink drops are ejected through print-head nozzles on to a media sheet, such as paper. The nozzles through which ink drops are ejected may become clogged with paper fibers or other debris during normal operation. The nozzles may also become clogged with dry ink during prolonged idle periods. Generally, print-head service stations are used for wiping the print-head and applying suction or blowing to the print-head to clear out any blocked nozzles.

Ink drop detectors may be used to determine nozzle health, such as whether a print-head actually requires cleaning, whether nozzles have failed, etc. A light-scattering drop detector is one type of drop detector that involves directing light, such as laser light, at ejected drops. The ejected drops scatter the light, and a light detector detects the scattered light and outputs an electrical signal indicative of the scattered light. The signal may be analyzed to determine various drop characteristics. One problem with existing light-scattering drop detectors is that they do not give information about more than one nozzle at substantially the same time.

DETAILED DESCRIPTION

In the following detailed description of the present embodiments, reference is made to the accompanying drawings that form a part hereof, and in which are shown by way of illustration specific embodiments that may be practiced. These embodiments are described in sufficient detail to enable those skilled in the art to practice disclosed subject matter, and it is to be understood that other embodiments may be utilized and that process, electrical or mechanical changes may be made without departing from the scope of the claimed subject matter. The following detailed description is, therefore, not to be taken in a limiting sense, and the scope of the claimed subject matter is defined only by the appended claims and equivalents thereof.

Figure 1:
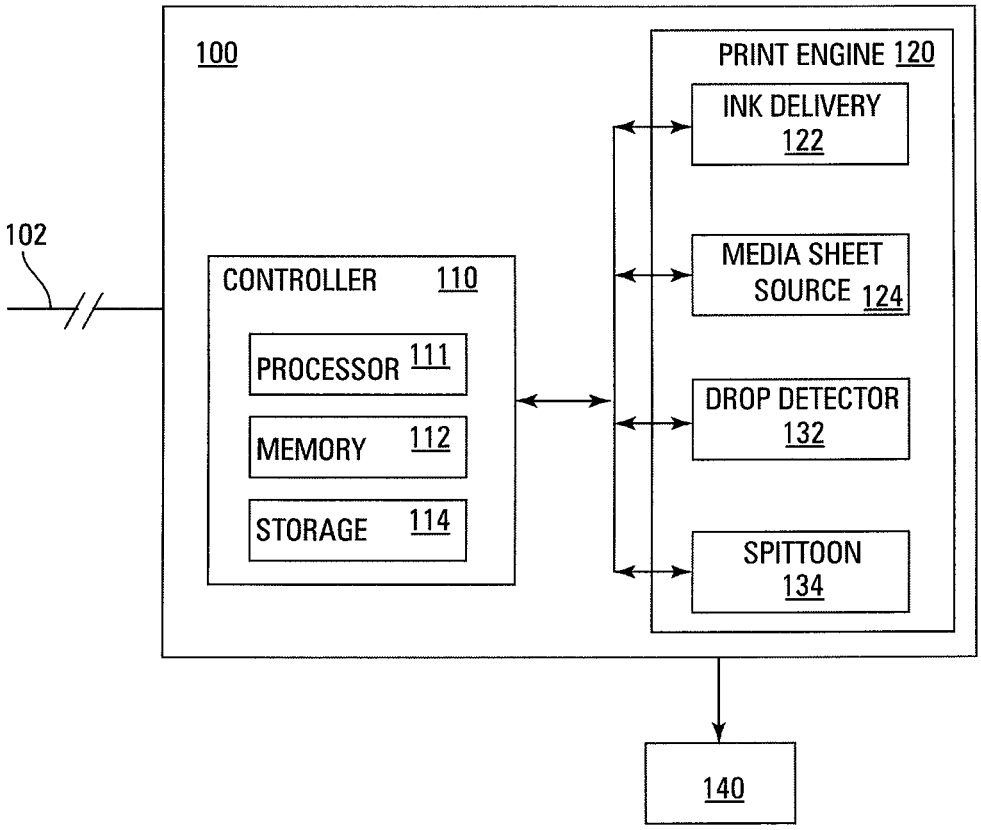
FIG. 1 is a block diagram of an embodiment of an imaging device, according to an embodiment of the disclosure.

FIG. 1 is a block diagram of an imaging device 100, such as an inkjet printer, e.g., a page-wide-array inkjet printer. Imaging device 100 may be coupled to a personal computer, workstation, or other processor-based device system directly or over a data network, such as a local area network (LAN), via an interface 102.

Imaging device 100, receives image data over interface 102. Imaging device 100 has a controller 110, such as a formatter, for interpreting the image data and rendering the image data into a printable image. The printable image is provided to a print-engine 120 to produce a hardcopy image on a media sheet 140, such as paper, transparent plastic, etc.

Controller 110 includes a processor 111 for processing computer-readable instructions. These computer-readable instructions are stored in a memory 112, e.g., a computer-usable storage media that can be fixedly or removably attached to imaging device 100. Some examples of computer-usable media include static or dynamic random access memory (SRAM or DRAM), read-only memory (ROM), electrically-erasable programmable ROM (EEPROM or flash memory), magnetic media and optical media, whether permanent or removable. Memory 112 may include more than one type of computer-usable storage media for storage of differing information types. For one embodiment, memory 112 contains computer-readable instructions, e.g., drivers, adapted to cause controller 110 to format the data received by imaging device 100, via interface 102 and computer-readable instructions to allow imaging device 100 to perform various methods, as described below. Controller 110 may further include a storage device 114, such as a hard drive, removable flash memory, etc.

Imaging device 100 includes an ink delivery system 122 that receives a media sheet 140 from a media sheet source 124, where ink delivery system 122 and media sheet source 124 may be portions of print-engine 120. Ink delivery system 122 includes fluid-ejection devices, such as print-heads, that are respectively fluidly coupled to marking-fluid reservoirs, such as ink reservoirs. The ink reservoirs may be integral with their respective print-heads or may be separated from their respective print-heads and fluidly coupled thereto by conduits. The print-heads have nozzles for ejecting ink drops onto the media sheets for creating a hardcopy image thereon. Media sheet source 124 and ink delivery system 122 are coupled to controller 110.

Imaging device 100 includes a drop detector 132 that may be part of print-engine 120. Imaging device 100 may include a spittoon 134, e.g., a part of a service station of imaging device 100. Spittoon 134 and the service station may be part of print-engine 120. Drop detector 132 and spittoon 134 are coupled to controller 110.

The print-heads can be moved to spittoon 134, so that the print-heads can eject (or spit) a predetermined number of drops of marking fluid (e.g., ink) through their nozzles into spittoon 134 to purge the nozzles of unwanted debris, such as dried ink, paper fibers, etc. For one embodiment, the print-heads may eject ink drops into spittoon 134 while drop detector 132 is executing a drop-detection routine. For example, the spittoon 134 may be positioned under the print-heads while drop detector 132 detects drops ejected into spittoon 134. However, for other embodiments, drop detection may be performed while the print-heads are ejecting drops on to the media sheets during printing.

Figure 2:
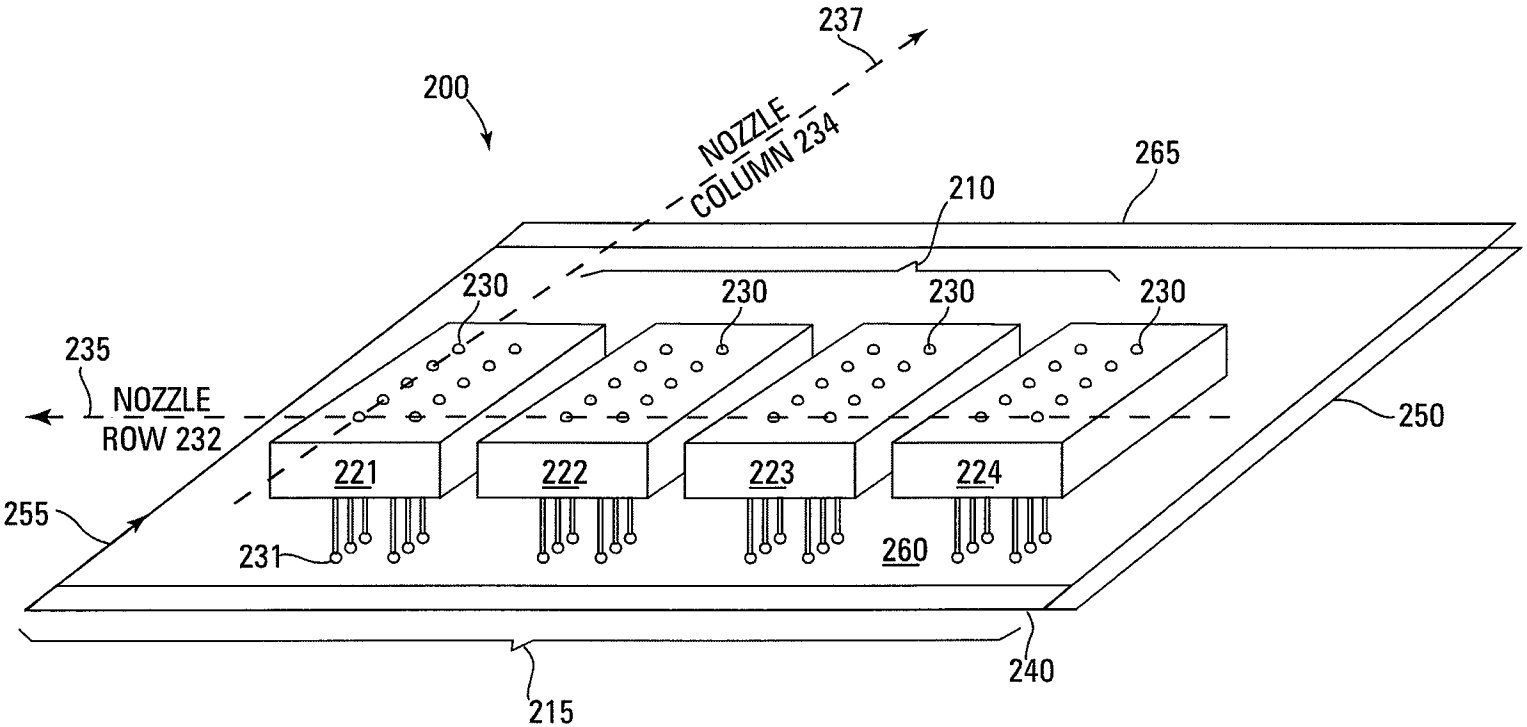
FIG. 2 is a perspective view showing an example of an embodiment of a drop-detection arrangement, according to another embodiment of the disclosure.

FIG. 2 is a perspective view showing an example of a drop detection arrangement 200 for drop detector 132. FIG. 2 also illustrates a print-head arrangement 210 for ink delivery system 122 and a sensing arrangement 215. Print-head arrangement 210 may include drop-ejectors, such as print-heads 221, 222, 223, and 224, e.g., respectively for yellow, magenta, cyan, and black ink. Print-head arrangement 210 may contain any reasonable number of print-heads. For example, print-head arrangement 210 may have only one print-head or it may have eight print-heads.

Each print-head has a plurality of nozzles 230 for firing ink drops 231. The nozzles 230 may be organized in rows 232 and columns 234. Rows 232 and columns 234 may be substantially perpendicular to each other. The print-heads may be conventionally supported on a carrier (not shown) to position them for firing and testing nozzles 230. For example, the print-heads may be moved above spittoon 134 for firing as part of a drop-detection routine.

The print-heads may be coupled to controller 110 for receiving electrical signals from controller 110 that cause the print-heads to eject drops 231 in response to receiving the electrical signals from controller. The electrical signals may be received at the print-heads as part of a printing routine, where printer 100 is printing on print media 140, or as part of a drop-detection routine, e.g., performed during printing or testing.

The print-heads may be thermal inkjet print-heads, where ink drops 231 are ejected in response to heating resistors in the respective print-heads. Alternatively, the print-heads may be impulse inkjet print-heads, where ink drops 231 are ejected in response to piezoelectric elements in the respective print-heads expanding. Ejecting ink drops thermally or piezoelectrically can be referred to as firing of nozzle firing. Nozzle firing is done in response to the resistors or piezoelectric elements receiving electrical signals from controller 110. Although thermal and piezoelectric inkjet print heads are presented as specific examples, the print heads can be any type of inkjet print heads, such as electro-spray, continuous jet, acoustic jet, or the like.

Print-head arrangement 210 may be a page-wide-array arrangement, where the print-heads are fixed or can be moved slightly, e.g., by about 20 pixels, in the column direction 237. During printing, the media sheets 140 move beneath the print-heads in the direction of arrow 235, for example, that is in the direction of nozzle rows 232 and substantially perpendicular to the nozzle columns 234. Alternatively, imaging device 100 may be a scanning-type printer, where the media sheets 140 move in the column direction 237 and the print heads move back and forth over the media sheets 140 in a direction that is parallel to the row direction 235 and substantially perpendicular to the motion of the media sheets 140.

Each print-head may span at least the entire width of a media sheet 140 in the column direction 237, substantially perpendicular to the direction of motion of the media sheet 140 during printing. Alternatively, it may take two or more of each of print-heads 221, 222, 223, and 224 to span at least the entire width of a media sheet 140. Although each print-head is shown to have two nozzle columns 234, each print-head may include one nozzle column or more than two nozzle columns.

Sensing arrangement 215 includes a light-source 240, such as a collimated and/or focused light-source, and a light detector 250, such as a photodetector. Light-source 240 may be coupled to controller 110 for receiving electrical signals from controller 110 that cause light-source 240 to emit light in response to receiving the signals from controller 110. Light-source 240 is arranged to emit a light beam 255, e.g., a collimated and/or focused light beam, in a parallel plane below print-head arrangement 210. Light-source 240 may include one or more LEDs, laser illumination devices (e.g., laser diodes), or the like. These may work in combination with an optical lens or polarizing device to direct light beam 255 into a plane (e.g., sheet) 260 of light, e.g., that spans print-heads 221 to 224 in the direction of the nozzle rows 232, as shown in FIG. 2.

Light beam 255 may travel in the column direction 237. Light-source 250 may be directed at an optional beam stopper 265 that acts to stop the plane 260 of light.

Although the plane 260 of light is shown oriented in a horizontal plane, light-source 240 may be angled so that the plane 260 of light may also be oriented at an angle to the horizontal in the row direction. For example, the plane 260 of light may angled in the row direction 235.

For one embodiment, light-source 240 may include a plurality of light-sources, where the light-sources correspond to the nozzle columns 234 on a one-to-one basis. For example, each light-source may be directed along a respective column of nozzles 230. Each light-source emits a light beam 255 (e.g., a collimated and/or focused beam of light) that is aligned with a respective column of nozzles 230. Each light-source may be an LED or laser illumination device (such as a laser diode). Each light beam 255 may be circular, elliptical, rectangular, or any other of a variety of shapes.

Light detector 250 spans two or more nozzle rows 232 in the column direction. For one embodiment, light detector may span an entire column 234 of nozzles, i.e., all of the nozzle rows 232 of a column 234 of nozzles, as shown in FIG. 2. Light detector 250 may be configured to sense, substantially concurrently, two or more drops respectively, substantially concurrently ejected from two or more nozzles in the column direction. For example, light detector 250 may be configured to sense, substantially concurrently, drops substantially concurrently ejected from an entire column 234 of nozzles 230.

Figure 3A:
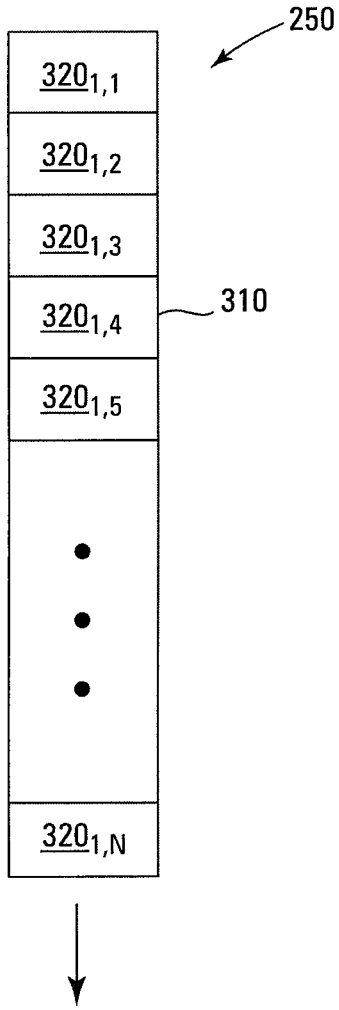
FIG. 3A illustrates an example of an embodiment of a line-sensor, according to another embodiment of the disclosure.

Light detector 250 may be a line-sensor 310 that includes a linear array of light-sensitive elements $\mathbf{320}_1$ to $\mathbf{320}_N$, as shown in FIG. 3A. The line-sensor 310 may be similar to the line-sensors commonly used in scanners. For one embodiment, the line-sensor 310 is a contact image sensor.

The linear array may be a 1 column by N row array with N light-sensitive elements 320 (e.g., $\mathbf{320}_{1,1}$ to $\mathbf{320}_{1,N}$ light-sensitive elements) in the column direction 237 and 1 light-sensitive element in the direction of the ejected drops 231. Each light-sensitive element 320 forms a pixel. However, some line sensors may have quasi-one dimensional (quasi-linear) arrays of light-sensitive elements having more than one column of light-sensitive elements, but where the number of columns of light-sensitive elements is much less than the number of rows of light-sensitive elements.

Figure 3B:
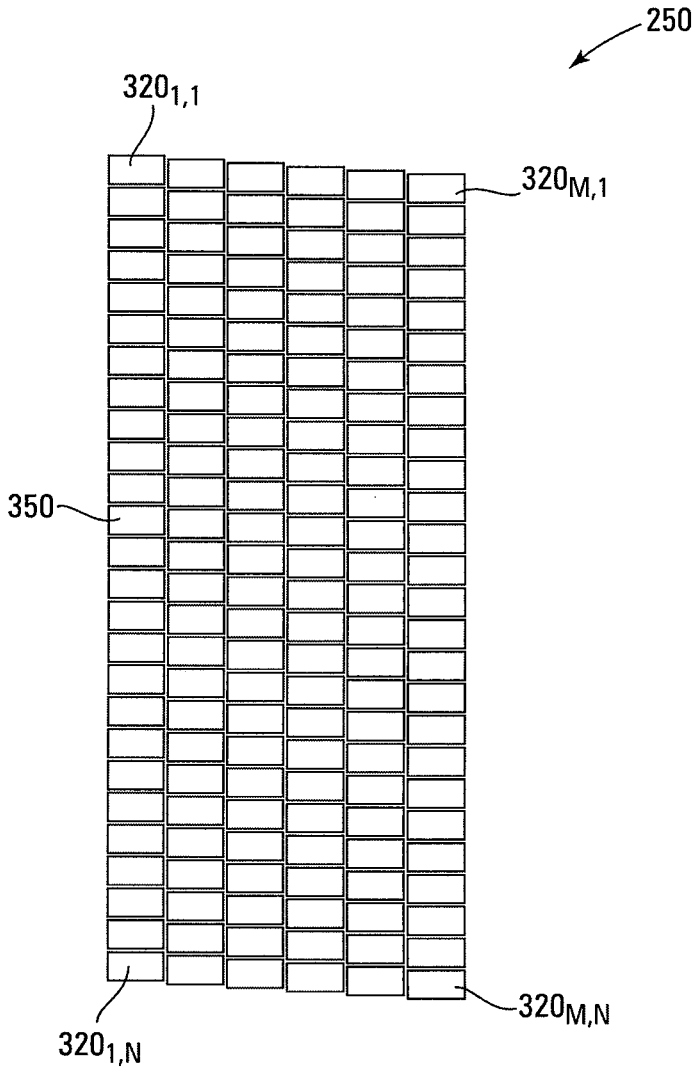
FIG. 3B illustrates an example of an embodiment of a two-dimensional light sensor, according to another embodiment of the disclosure.

For another embodiment, light detector 250 may be a two-dimensional light sensor 350, as shown in FIG. 3B. Two-dimensional light sensor 350 has a two-dimensional array of light-sensitive elements with M columns of light-sensitive elements 320 by N rows of light-sensitive elements, i.e., two-dimensional light sensor 350 has light-sensitive elements $\mathbf{320}_{1,1}$ to $\mathbf{320}_{M,N}$.

The light-sensitive elements 320 of two-dimensional light sensor 350 may be organized to form a staggered array of light-sensitive elements 320, where successive light-sensitive elements 320 along each row of the array are staggered or misaligned with each other, as shown in FIG. 3B. Note that the staggering of light-sensitive elements 320 acts to increase spatial resolution.

Alternatively the light-sensitive elements 320 of two-dimensional light sensor 350 may be organized to form an in-line array of light-sensitive elements 320, where the respective light-sensitive elements 320 along each row of the array are aligned with each other and the respective light-sensitive elements 320 along each column of the array are aligned with each other. Note that the in-line arrangement acts to increase the sensitivity of the light sensor.

For one embodiment, there may be one or more light-sensitive elements 320 (pixels) per nozzle 230, e.g., per drop 231. For example, there may be multiple (e.g., 5 to about 10) light-sensitive elements 320 per nozzle 230. Each group of one more light-sensitive elements 320 corresponding to a nozzle 230 defines a light-sensing location of the line-sensor 310, meaning that the light-sensing locations of the line-sensor 310 or two-dimensional light sensor 350 respectively correspond to the nozzles 230 of each nozzle column 234. For example, for two-dimensional light sensor 350, a light-sensing location may be one or more rows of two-dimensional light sensor 350 by M columns of two-dimensional light sensor 350. Each light-sensitive element may be a CCD (charge coupled device), a CMOS (complimentary metal oxide semiconductor) device, a PIN diode photodetector, an avalanche photodetector (APD), or the like.

The line-sensor 310 or two-dimensional light sensor 350 may be configured to substantially concurrently sense light that is scattered by two or more drops 231 respectively at two or more different spatial locations of the line-sensor 310 or two-dimensional light sensor 350, e.g., at two or more light-sensing locations that may include one or more pixels. For example, line-sensor 310 or two-dimensional light sensor 350 may configured to substantially concurrently sense light that is scattered by drops 231 substantially concurrently ejected from the nozzles 230 of an entire column of nozzles at the light-sensing locations respectively corresponding to those nozzles 230.

Figure 4:
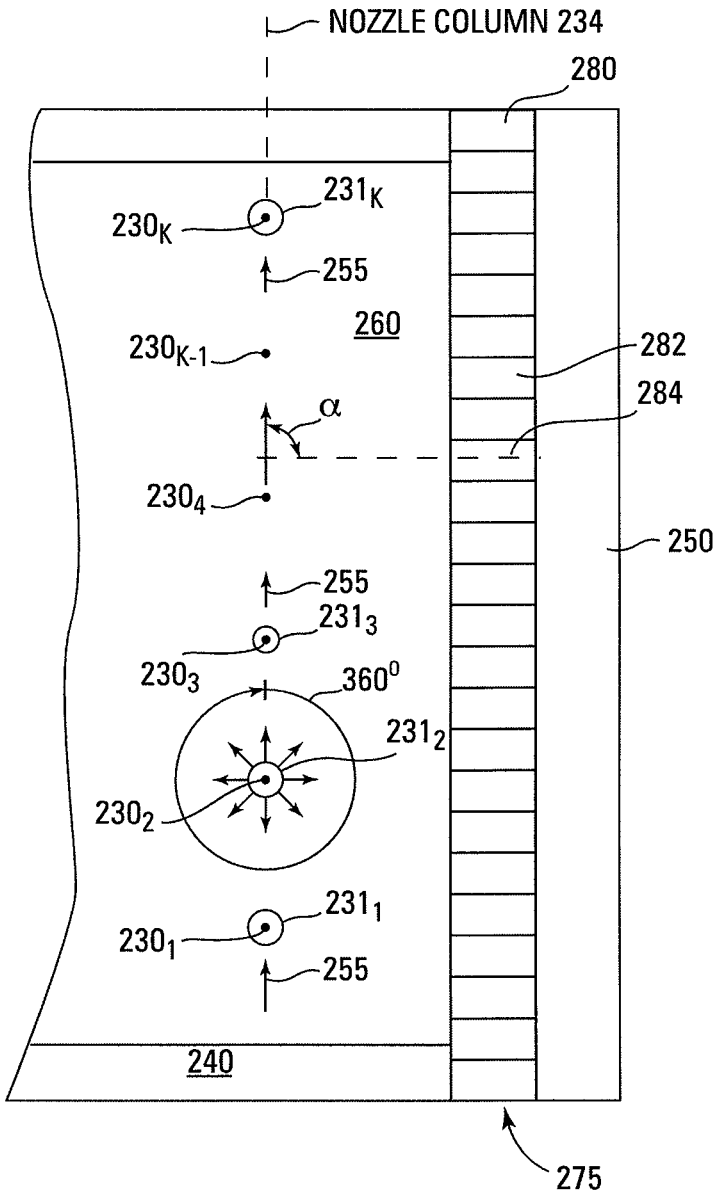
FIG. 4 is a top view of a portion of FIG. 2, according to another embodiment of the disclosure.

FIG. 4 is a top view of a portion of FIG. 2, illustrating ink drops $\mathbf{231}_1$, $\mathbf{231}_2$, $\mathbf{231}_3$, and $\mathbf{231}_K$ crossing light beam 255 in the form the plane 260 of light for after being ejected substantially currently from a column 234 of nozzles 230. For example, drops $\mathbf{231}_1$, $\mathbf{231}_2$, $\mathbf{231}_3$, and $\mathbf{231}_K$ may be respectively ejected from nozzles $\mathbf{230}_1$, $\mathbf{230}_2$, $\mathbf{230}_3$, and $\mathbf{230}_K$. Note that the light may be scattered off drops $\mathbf{231}_1$, $\mathbf{231}_2$, $\mathbf{231}_3$, and $\mathbf{231}_K$ substantially concurrently.

Nozzles $\mathbf{230}_1$ to $\mathbf{230}_K$ of column 234 were activated (e.g., fired) substantially concurrently. Note that no drops are ejected from nozzles $\mathbf{230}_4$ and $\mathbf{230}_{K-1}$. The absence of these drops may indicate that nozzles $\mathbf{230}_4$ and $\mathbf{230}_{K-1}$ failed to fire or are misfiring. The presence of drops $\mathbf{231}_1$, $\mathbf{231}_2$, $\mathbf{231}_3$, and $\mathbf{231}_K$ may indicate that nozzles $\mathbf{230}_1$, $\mathbf{230}_2$, $\mathbf{230}_3$, and $\mathbf{230}_K$ are firing. Subsequently, light detector 250 detects the drops $\mathbf{231}_1$, $\mathbf{231}_2$, $\mathbf{231}_3$, and $\mathbf{231}_K$ substantially concurrently at respectively the different light-sensing locations of light detector 250, where each light-sensing location includes one or more light-sensing elements 320 (FIG. 3).

The size of the ink drop provides further information pertaining to the working status of the nozzle. For example, an ink drop, such as ink drop $\mathbf{231}_3$, that is smaller than usual indicates that a particular nozzle, such as nozzle $\mathbf{230}_3$, may be partially clogged or misfiring. The location of an ink drop 230 may also provide further information. For example, an ink drop that is in an unusual position or angle may suggest that a nozzle is skewed.

As the drops 231 cross light beam 255, the light is scattered in all directions. Viewed in another way, light beam 255 moves away from light-source 240 along the column direction toward drops 231, strikes drops 231, and is scattered within the plane 260 of light over an angle of 360 degrees around a drop 231, as shown in FIG. 4 for drop $\mathbf{231}_2$. This means that light-sensor 250 can be placed at various angles around the drop to detect the light scattered from a drop 231.

Figure 5:
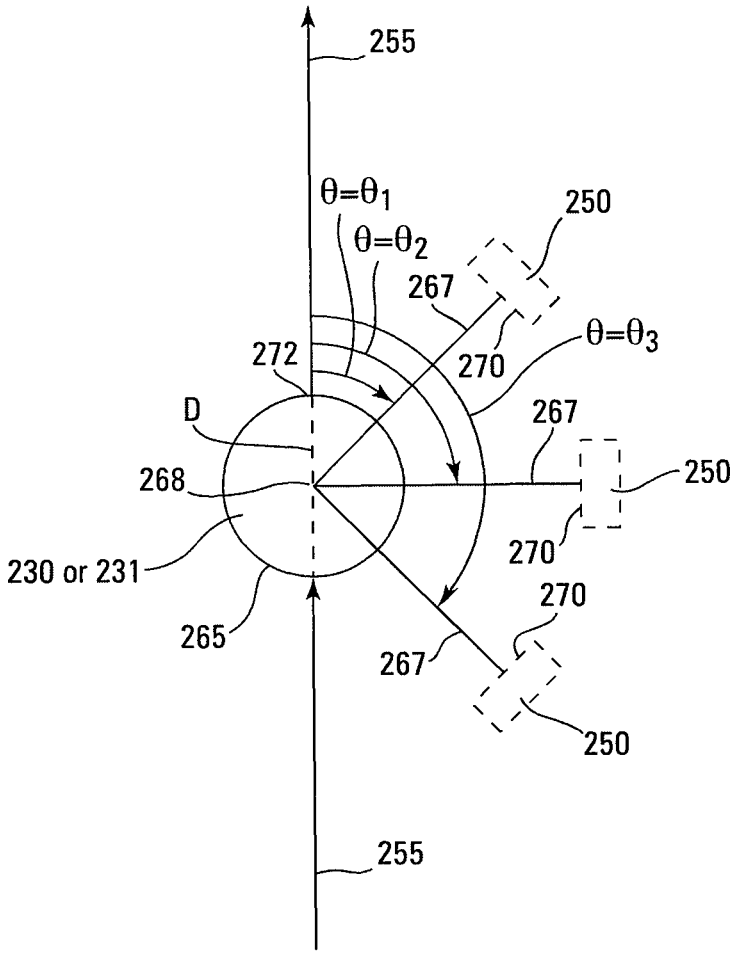
FIG. 5 is a top view showing a light-sensor located at various angles around a circumference of a nozzle (or ejected drop) for sensing light scattered from the drop, according to another embodiment of the disclosure.

FIG. 5 is a top view showing that light-sensor 250 can be located at various angles around the circumference 265 of a nozzle 230 (or drop 231) for sensing light scattered from drop 231. That is, FIG. 5 demonstrates that light-sensor 250 can be located so that a line 267, originating from the center 268 of the nozzle 230 and making an angle of $\theta=\theta_1$, $\theta_2$, or $\theta_3$ with the direction of light beam 255, e.g., the column direction, is substantially perpendicular to a sensing surface 270 of light-sensor 250.

The angle $\theta$ is measured in a clockwise direction around the circumference 265, as nozzle 230 is viewed from the top, from a location 272 on circumference 265 where light beam 255 is moving away from the nozzle 230 and where a diameter D of the nozzle 230 that is oriented in the direction of light beam 255 intersects circumference 265. As such, line 267 makes the angle $\theta=\theta_1$, $\theta_2$, or $\theta_3$ with the diameter D that is oriented in the direction of light beam 255.

Viewed in another way, light-sensor 250 may be located such that a normal to sensing surface 270 is located at the angle $\theta$ from the direction of light beam 255, where the angle $\theta$ is measured clockwise, as drop 231 is viewed from the top, from a location on drop 231 (location 272) where light beam 255 is moving away from drop 231 and that lies on a light beam 255 that substantially bisects drop 231.

Note that the direction of light beam 255 may be substantially the same as the column direction 237, as shown in FIG. 2. That is, light beam 255 may be substantially parallel to columns 234. Therefore, the normal to sensing surface 270 may be located at the angle $\theta$ from the column direction 237.

For one embodiment, the angle $\theta$ is between zero and 180 degrees ($0<\theta<180$). For another embodiment, the angle $\theta$ ranges from about 10 degrees to about 90 degrees. Alternatively, the angle $\theta$ may range from about 10 degrees to about 50 degrees. It is noted that the strongest scattering occurs for an angle $\theta$ ranging from about 10 degrees to about 50 degrees. For a further embodiment, the angle $\theta$ ranges from about 15 degrees to about 30 degrees. Note that sensor 250 is oriented at an angle $\theta$ of substantially 90 degrees for the sensing arrangement 215 of FIG. 2.

For another embodiment, an optical system 275 may be located in front of light-sensor 250, as shown in FIG. 4. Optical system 275 is configured to direct the light scattered from drops 230 to light-sensor 250. Note that optical system 275 may be integrated into light-sensor 250 to form an integral component of light-sensor 250. Optical system 275 may include imaging optics, such as lenses, and non-imaging optics, such as light pipes, reflectors, or the like.

Optical system 275 may include a lens array 280, as shown in FIG. 4. Lens array 280 may include a series of lens elements 282. Each lens element 282 has an optical axis 284 that makes an angle $\alpha$ with the direction of light beam 255. Although the angle $\alpha$ is substantially 90 degrees in FIG. 4, the angle $\alpha$ may be between 0 and 180 degrees ($0<\alpha<180$).

Note that lens array 280 may form an integral component of light-sensor 250. For example, light-sensor 250 may be a linear contact image sensor with an integrated lens array. Non-limiting examples of a suitable lens array, include a Fresnel lens array and gradient index lens array, such as a SELFOC lens array manufactured by Nippon Sheet Glass Co., Ltd., Osaka, Japan.

Figure 6:
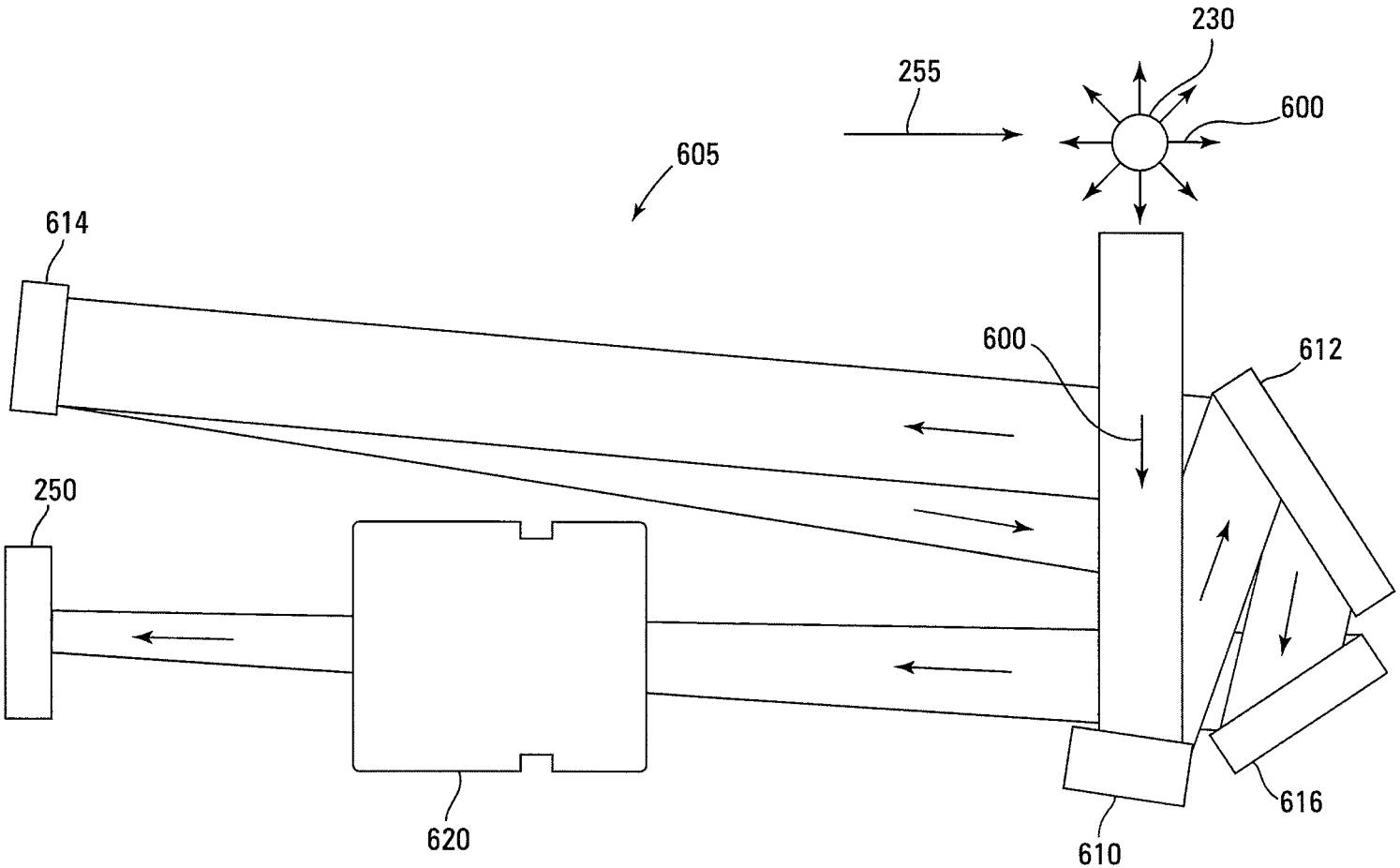
FIG. 6 is a side view illustration of an example of a reduction optics system, according to another embodiment of the disclosure.

Optical system 275 may include a reduction optics system, such as reduction optics system 605 shown in FIG. 6. Reduction optics system 605 includes reflectors (e.g., mirrors) 610, 612, 614, and 616 and reduction optics 620 that reduce the size of the image, e.g., by about 12 to about 25 percent. During operation, light 600 from light beam 255 is scattered by a drop 230 onto reflector 610. Reflector 610 reflects light 600 onto reflector 612 that reflects light 600 onto reflector 614. Reflector 614 reflects light 600 onto reflector 616 that reflects light 600 through reduction optics 620 to reduce the image of drop 230 contained in light 600. Reduction optics 620 direct light 600 to light-sensor 250. Note that reflectors 610, 612, 614, and 616 act to produce a folded light path, as shown in FIG. 6.

Figure 7:
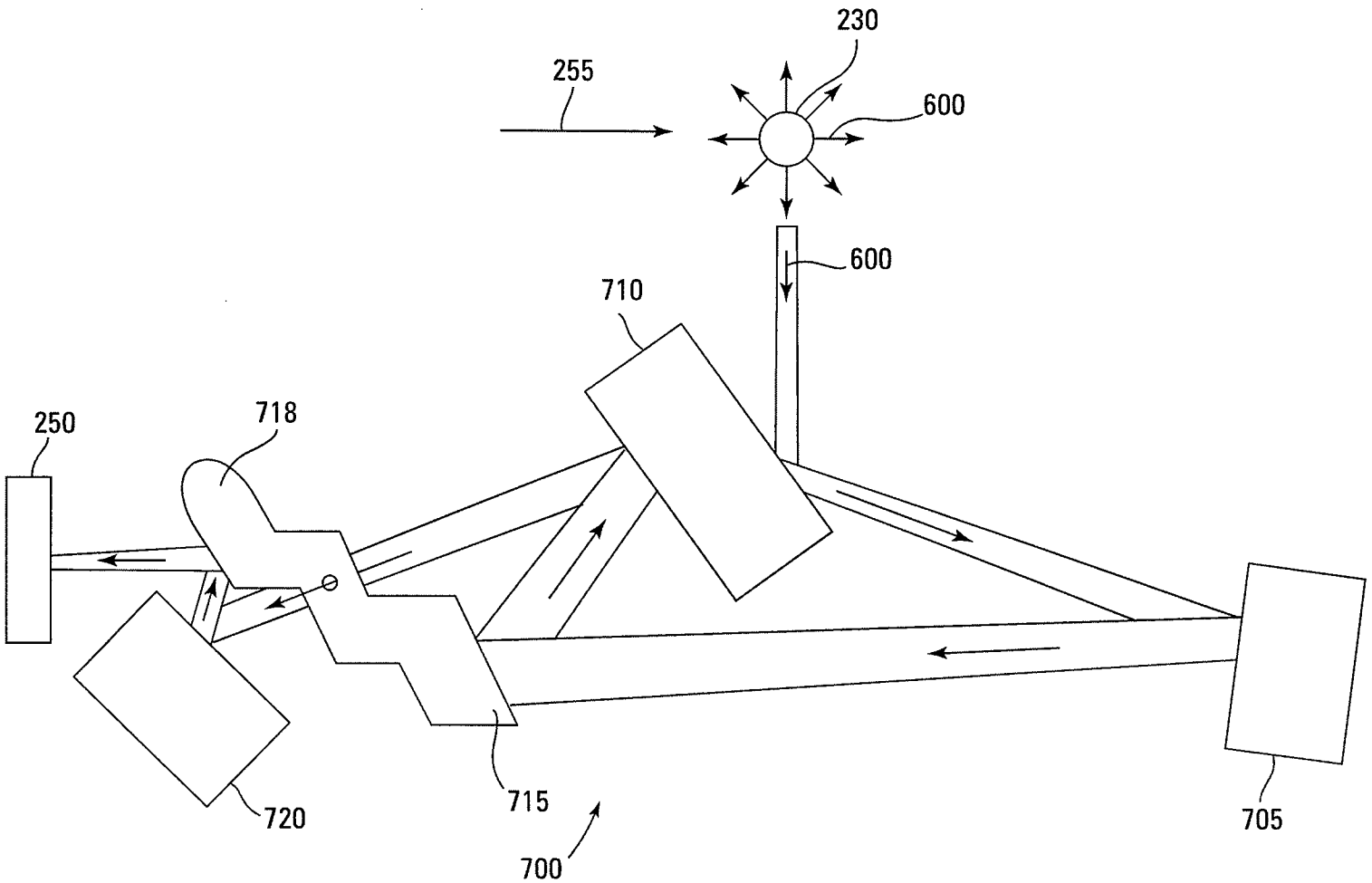
FIG. 7 is a side view illustration of an example of a telecentric array of reflective optics, according to another embodiment of the disclosure.

Alternatively, optical system 275 may include a telecentric array 700 of reflective optics, as shown in FIG. 7. The telecentric array 700 of reflective optics includes reflectors (e.g., mirrors) 705, 710, and 720, an aspherical reflector (e.g., a mirror) 715, and a spherical reflector (e.g., a mirror) 718. Light 600 from light beam 255 is scattered by drop 230 onto reflector 710. Reflector 710 reflects light 600 to reflector 705 that reflects light 600 to aspherical reflector 715. Aspherical reflector 715 reflects light 600 to reflector 710 that reflects light 600 through an aperture between aspherical reflector 715 and spherical reflector 718 and onto reflector 720. The reflector 720 reflects light 600 onto spherical reflector 718 that reflects light 600 onto light-sensor 250. Note that telecentric array 700 acts to produce a folded light path, as shown in FIG. 7.

Reflector 705 may be optional in which case light 600 is scattered directly onto aspherical reflector 715. Aspherical reflector 715 then reflects light 600 to reflector 710 that reflects light 600 through the aperture between aspherical reflector 715 and spherical reflector 718 and onto reflector 720. The reflector 720 reflects light 600 onto spherical reflector 718 that reflects light 600 onto light-sensor 250.

After substantially concurrently sensing light scattered from two or more drops 231, light-sensor 250 converts the sensed light into an electrical signal (e.g., a current signal or a voltage signal) that is sent to controller 110 (FIG. 1). That is, light-sensitive elements 320 (FIG. 3) convert the sensed light into electrical signals, e.g., in the form of a voltage or a current.

Each drop 231 is identified from the detected light intensity of a group of one or more of light-sensitive elements 320 (FIG. 3), e.g., that forms a light-sensitive location of line-sensor 310 or two-dimensional light sensor 350. The detected light intensity is directly proportional to the strength of the electrical signals output by light-sensitive elements 320. For example, the light intensity is directly proportional to the magnitude of the voltage or current output by light-sensitive elements 320.

Storage device 114 (FIG. 1) may store a mapping that maps a light-sensing location, e.g., that includes a group of one or more of light-sensitive elements (e.g., pixels) 320, of line-sensor 310 or two-dimensional light sensor 350 to each nozzle 230 in each nozzle column 234. For example, the location of each nozzle (e.g., corresponding to a row of nozzles) within a nozzle column 234 is associated with a respective light-sensing location of line-sensor 310 or two-dimensional light sensor 350.

Based on the various light intensities, in the form of the electrical signals received at controller 110 from light-sensitive elements 320, controller 110 determines drop characteristics, such as the presence and/or absence of drops 231, drop size, e.g. drop volume, drop falling angle, drop location, and drop speed. A predetermined low-threshold light intensity, e.g., in the form of a predetermined low-threshold voltage or current magnitude, may indicate the presence of an ink drop 231. Similarly, a predetermined high-threshold may indicate the absence of an ink drop 213.

The magnitude of a voltage or current from a light-sensitive element 320 may be compared to the predetermined low-threshold voltage or current magnitude to determine the presence of an ink drop 231. For example, when the magnitude of a voltage or current from a light-sensitive element 320 is greater than or equal to the predetermined low-threshold voltage or current magnitude, a drop 231 is present. Similarly, the magnitude of a voltage or current from a light-sensitive element 320 may be compared to a predetermined high-threshold voltage or current magnitude to determine the absence of an ink drop 231. For example, when the magnitude of a voltage or current from a light-sensitive element 320 is less than or equal to the predetermined low-threshold voltage or current magnitude, a drop 231 is absent. The predetermined low- and high-threshold voltage or current magnitudes may be stored in storage device 114 of controller 110 (FIG. 1).

A drop 231 crossing light beam 255 generates a continuous optical signal. Light detector 250 converts the signal into the electrical signal that is sent to controller 110. Controller 110 may be configured to determine the speed of drop 231, for one embodiment, by determining the time it takes for drop 231 to traverse the beam width and dividing the beam width by the determined time. Controller 110 may further compare the determined drop speed to a certain drop speed. Controller 100 may then determine that the drop speed is satisfactory when the determined speed is within a certain percentage of the certain speed.

Light beam 255, e.g., in the form of the plane 260 of light or other shape, may be located between the print-heads and a spittoon, such as spittoon 134 (FIG. 1). For example, drop detection may performed during a servicing or testing operation as the print-heads eject drops through light beam 255 and into the spittoon. The spittoon may be moved to the print-heads, or the print-heads may be moved to the spittoon.

For another embodiment, drop detection may be performed during a printing operation. In this embodiment, light beam 255 is located between the print-heads and a media sheet, such as media sheet 140 (FIG. 1). During drop detection, the print-heads eject drops through light beam 255 and onto the media sheet. For one embodiment, after analyzing the drops, controller 110 may make corrections, during the printing, based on the analysis. For example, controller 110 may adjust nozzle firing parameters during printing. The nozzle firing parameters may include voltage pulses applied to a resistor or piezoelectric element that fires a drop, the width of the voltage pulse, and/or the frequency of the voltage pulses.

For one embodiment, drop detection may be performed on per column basis, e.g., for one column of nozzles at a time that is selected for drop detection. For example, drop detection may involve substantially concurrently firing drops 230 from two or more or all of the nozzles 230 of a selected nozzle column 234 (FIG. 2) and substantially concurrently sensing the substantially concurrently fired drops at light-detector 250. This process is repeated for each nozzle column 234.

Embodiments of the disclosure enable the concurrent detection of two or more drops fired substantially concurrently. Therefore, avoiding the problems with existing light-scattering drop-detectors that typically detect drops from one nozzle at a time and thus do not give information about other nozzles at substantially the same instant in time.

The light scattering drop detectors of the disclosed embodiments have the advantage of enabling a bright signal on a dark background as opposed conventional shadow drop detectors that direct the light detector directly at the light source, producing blinding. The light scattering drop detectors of the disclosed embodiments are also less sensitive to aerosol particles with sizes on the order of the wavelengths of the light produced by the light source than shadow drop detectors. Sensitivity to aerosol particles produces diffraction pattern noise that can lead to the false detection of drops and pixel crosstalk. In addition, the light scattering drop detectors of the disclosed embodiments are substantially insensitive to the alignment between the light source and detector, whereas shadow drop detectors are highly sensitive to the alignment between the light source and detector.

CONCLUSION

Although specific embodiments have been illustrated and described herein it is manifestly intended that the scope of the claimed subject matter be limited only by the following claims and equivalents thereof.

What is claimed is:

1. A drop detector, comprising:

a light-source configured to scatter light off two or more substantially currently ejected drops; and a light detector configured as an array comprising a plurality of discrete light-sensing elements in order to substantially concurrently sense, respectively at two or more different spatial locations associated with two or more of the discrete light-sensing elements, the light scattered off the two or more substantially currently ejected drops;

wherein light scattered from at least one of the two or more substantially currently ejected drops is identified from the light scattered off the two or more substantially currently ejected drops using a correlation between the spatial location of the discrete light-sensing elements of the light detector and the at least one ejected drop; and wherein, for each ejected drop, two or more discrete light-sensing elements are configured to collect light scattered off that drop.

2. The drop detector of claim 1, further comprising an optical system located in front of the light detector, the optical system configured to direct the light from the light-source that is scattered by the two or more drops respectively to the two or more different spatial locations of the light detector.

3. The drop detector of claim 2, wherein the optical system comprises a lens array.

4. The drop detector of claim 3, wherein the lens array comprises lens elements, wherein each lens element has an optical axis that forms an angle between zero and 180 degrees with a direction of a light beam from the light-source.

5. The drop detector of claim 2, wherein the optical system is selected from the group consisting of a Fresnel lens array, a gradient index lens array, a reduction optics system, and a telecentric array of reflective optics.

6. The drop detector of claim 1, wherein the light detector comprises a linear array of light-sensitive elements, a two-dimensional staggered array of light-sensitive elements, or a two-dimensional in-line array of light-sensitive elements.

7. The drop detector of claim 1, wherein the light detector is a compact image sensor with integrated optics.

8. The drop detector of claim 1, wherein the light detector is located so that a normal to a detection surface of the light detector makes an angle between zero and 180 degrees with a direction of a light beam from the light-source.

9. A drop-detection method, comprising:

ejecting two or more drops from a drop ejector substantially concurrently;

scattering light off of the substantially concurrently ejected two or more drops;

respectively, substantially concurrently sensing the light scattered off of the two or more drops at two or more different locations associated with two or more discrete light-sensing elements of an array of discrete light-sensing elements of a light detector;

converting two or more optical signals respectively corresponding to the two or more drops to two or more electrical signals respectively at the two or more different locations of the light detector; and transmitting the two or more electrical signals to a controller;

wherein light scattered from at least one of the two or more substantially currently ejected drops is identified from the light scattered off the two or more substantially currently ejected drops using a correlation between the spatial location of the discrete light-sensing elements of the light detector and the at least one ejected drop; and wherein, for each ejected drop, two or more discrete light-sensing elements are configured to collect light scattered off that drop.

10. The method of claim 9, further comprising directing the light scattered off of the two or more drops through an optical system to the two or more different locations of the light detector before substantially concurrently sensing the light scattered off of the two or more drops at the two or more different locations of the light detector.

11. The method of claim 9, wherein the light detector is located so that a normal to a detection surface of the light detector makes an angle between zero and 180 degrees with a direction of an unscattered light beam that is directed at the two or more drops for scattering.

* * * * *